United States Patent [19]

Urban

[11] 4,007,620

[45] Feb. 15, 1977

[54] METAL CONTAINER FORMING APPARATUS

[75] Inventor: Joseph J. Urban, Pleasantville, N.Y.

[73] Assignee: Crown Cork & Seal Company, Inc., Philadelphia, Pa.

[22] Filed: June 11, 1975

[21] Appl. No.: 586,023

[52] U.S. Cl. ..... 72/345

[51] Int. Cl.[2] ..... B21D 45/00

[58] Field of Search ..... 10/11 E; 72/344, 345, 72/346, 347, 348, 349, 361, 427

[56] References Cited

UNITED STATES PATENTS

| | | | |
|---|---|---|---|
| 2,547,304 | 4/1951 | Broscomb | 10/11 E |
| 2,800,813 | 7/1957 | Fischer | 72/347 |
| 3,270,544 | 9/1966 | Maeder et al. | 72/348 |
| 3,289,453 | 12/1966 | Wyle et al. | 72/349 |
| 3,364,721 | 1/1968 | Criblez | 72/345 |
| 3,702,559 | 11/1972 | Hasselbock et al. | 72/349 |
| 3,704,619 | 12/1972 | Paramonoff | 72/349 |
| 3,911,719 | 10/1975 | Degenhardt et al. | 72/345 |
| 3,924,436 | 12/1975 | Misonoo | 72/345 |

FOREIGN PATENTS OR APPLICATIONS

| | | | |
|---|---|---|---|
| 972,615 | 8/1959 | Germany | 72/347 |
| 1,087,554 | 8/1960 | Germany | 72/345 |

*Primary Examiner*—C.W. Lanham
*Assistant Examiner*—E. M. Combs
*Attorney, Agent, or Firm*—Woodcock Washburn Kurtz & Mackiewicz

[57] ABSTRACT

An improved apparatus for forming drawn and ironed containers from metal blanks. A duplex drive mechanism rotated by a single motive device translates rotary into recipricatory motion by means of pivoted levers, transmitting it to the reciprocating carriages of a pair of juxtaposed machines through linkages having disengagable latches so that one machine may be disconnected while the other remains in operation. A pair of disc-like cams are provided, one operating a stripper punch disposed within an ironing ram used to advance metal blanks through successively smaller forming dies. The other cam is used to control the operation of a redraw die disposed about the ironing ram and which acts in concert with the ram to redraw blanks fed into the machine. Each carriage is articulated, force being applied to a rear portion of the carriage through linkages coupled to a source of motive power. A toggle linkage for operating the stripper punch is also carried by the rearward portion of the carriage. The ironing ram itself is carried by the forward portion of the carriage, the articulation joint in the carriage serving to isolate the forward portion from lateral forces applied to the rear portion.

18 Claims, 6 Drawing Figures

METAL CONTAINER FORMING APPARATUS

BACKGROUND OF THE INVENTION

The present invention relates to container forming apparatus, and more particularly to a machine for drawing and ironing one-piece metal container bodies.

The prior art is replete with examples of various types of mechanisms adapted to draw, iron, or to draw and iron, metallic blanks so as to form cup-like one piece metal container bodies. Such apparatus commonly comprise an elongate, cylindrical ram which is adapted to urge cupped metal blanks through a series of annular dies of progressively smaller diameter. This procedure accomplishes two ends: it progressively thins the lateral walls of the cylindrical container being formed over the end of the ram, and causes the metal so displaced to cold flow along the surface of the ram so as to axially elongate the side walls of the container. The container may then be stripped from the end of the ram; or, if a particular configuration such as the widely-used concave indentation is to be imparted to the container bottom a resilient "doming" die is provided to receive the ram at the furthest point of its advance, and the end of the ram is provided with a suitable mating configuration. The cooperation between the end of the ram and the doming die indents or domes the container bottom, after which the ram may be withdrawn from within the container body and the body transferred by means of a outfeed mechanism to subsequent machinery for trimming, capping, etc.

The elongate ram described above is commonly carried by a reciprocative element termed a carriage. The carriage is supported by and rides in guides or ways formed in the main frame of the machine proper. The carriage is commonly provided with rollers, or arranged to slide upon a lubricated surface in the manner of a hydrostatic bearing. In order to effect reciprocation of the carriage it is known to use either hydraulic means, or a mechanical linkage such as a crankshaft and connecting rod arrangement. With most prior art devices, a problem arises when it is desired to adapt a container-forming mechanism to produce containers of varying depth. In order to accommodate the deepest container to be formed, a relatively long stroke must be provided to the carriage. However, when forming relatively shallow containers much of the travel of a long stroke is superfluous and comprises wasted time and effort.

A further problem which inhered in many prior art arrangments was the difficulty in minimizing the "runout", or lateral deviation from an ideal path, of the carriage and thus of the ram which it carries. Due to the necessarily small clearance between the ram and the annular ironing dies through which it passes, slight deviations from concentricity result in the formation of containers with unacceptably thin wall sections. As the elongate ram extends a considerable distance from the forward end of the supporting carriage, it will be appreciated that small deviations or runout in carriage travel are in effect amplified by the relative length of the ram and so may cause major lateral deviations at the ram end. While a portion of the runout of the carriage can be eliminated by careful adjustment of machine bearings and ways, a certain amount of clearance is always necessary. This clearance inherently produces a degree of lateral movement of the carriage when it is subjected to substantial lateral forces by the driving mechanism.

While the carriage is conventionally urged forward and back by pivoted linkages which may include low-friction bearings or bushings, as exemplified by U.S Pat. No. 3,270,544 — Maeder et al, a certain amount of lateral force is nonetheless transmitted from the driving linkage to the end of the carriage. Since the linkage is often coupled to the rearmost portion of the carriage, the leverage thus provided may result in an unacceptable cocking or lateral deviation of the carriage.

Also as depicted in the aforementioned U.S. Pat. No. 3,270,544 it is known to provide an elongate extensible stripper punch within an ironing ram for aiding in the removal of a finished container from the ram end. Such a stripper punch is commonly in the form of an elongate rod or tube, and is periodically urged forward by mechanical means. When such mechanical means are mounted upon the carriage which supports the ram, additional forces are brought to bear upon the carriage which further deflect it from its desired path along the ways of the machine frame.

The mechanism used to operate the stripper punch has long presented a difficult design problem due to the fact that the punch is carried within the reciprocating carriage. In one prior art approach, shown in U.S. Pat. No. 3,712,107, a stationary cam is disposed near the ways in which the carriage rides, and an element coupled to the stripper punch extends from the carriage for engaging the stationary can. This approach, however, has serious deficiencies including the accelerated wear which may occur if the system is adapted to control the operation of the punch throughout its entire travel. U.S. Pat. No. 3,702,559 — Hasselbeck et al also suggests the use of a cam, but of the cumbersome and expensive drum variety.

In other cases the stripper punch has been spring biased, and periodically urged from within the ram when an extended portion of the punch encounters a stationary member located adjacent the path of the carriage. In this case, however, the return of the stripper punch to a seated position within the ram is occasioned by the sudden release or disengagement of the stripper punch by the stationary element, so that the punch undergoes a severe impact as it is seated within the ram by the force of the biasing spring.

It has been conventional to drive each container forming machine with individual motive means, such as a large electric motor. Such a motor is commonly coupled by means of a belt drive to a large flywheel for maintaining consistent operation of the machine, as is well understood by those skilled in the art. Coupled to the flywheel in turn is a suitable clutch assembly, along with means carrying a crankpin offset from the center of rotation for imparting reciprocal motion to the carriage within the machine. This arrangement, while relatively straightforward, necessitates the provision of a bulky and expensive driving mechanism for each machine and moreover prevents the close positioning of multiple machines in a factory. Consequently, a plurality of machines require an inordinately large floor space.

In some cases it is desirable to perform an additional drawing operation on metal blanks preparatory to the elongation or ironing of the blanks. To this end, it is known to position an annular drawing die concentrically with the machine ram, and advance it along with the ram for the initial portion of the ram's travel. During the first stage of this operation the ram remains disposed within the confines of the surrounding drawing die, so that the ram and drawing die advance together as a single unit to force a metal blank into a cooperating female drawing die. The ram then advances through the abutted drawing dies, pulling the metallic blank therethrough and subsequently through the succeeding ironing dies. In order to properly locate the drawing die and operate it in synchronism with the ram, various mechanical drive systems have been devised. However, in order to provide the proper synchronism and motion to the drawing die it is commonly been necessary to add an entire motive mechanism to the container forming machine, which adds considerably to the cost and complexity of the machine.

It will therefore be seen that it would be desirable to provide an improved container forming machine, including a compact auxiliary drive mechanism for a drawing die attachment. It will also be understood that it would be highly desirable to provide a one-piece container forming machine which has an improved stripper punch mechanism, and having a ram-carrying carriage less susceptible to lateral displacement than any heretofore known in the prior art. Finally, it will be evident that it would be advantageous to provide motive means for operating a plurality of container forming machines while such machines are closely positioned one with another.

It will therefore be understood that an object of the present invention is to provide a common drive means for operating a plurality of juxtaposed container forming machines.

Another object of the present invention is to provide improved actuation means for controlling the operation of a stripper punch disposed within the reciprocating ram of a container forming machine.

Still another object of the invention is to provide a compact mechanism in a container forming machine for operating a redraw die in concert with an ironing ram.

Another object of the present invention is to provide a container forming machine with a carriage and ram assembly which is less susceptible to transverse displacement than any known in the prior art.

SUMMARY OF THE INVENTION

Briefly stated, in accordance with one aspect of the invention the foregoing objects are achieved by providing a single flywheel assembly with a crankpin. A pair of connecting rod elements couple a pair of elongated pivoted levers to the crankpin. The points at which the connecting rod elements meet the pivoted levers may be varied to alter the resulting stroke. Each of the levers is provided with a latching means for selectively decoupling one or both driver mechanisms from the common drive means.

A cam carried by the drive means operates through a linkage system including an elongate pivoted arm to cooperate with a toggle pivotally mounted upon a reciprocatory carriage, one end of the toggle engaging the rearward extremity of a stripper punch. The arm follows at least a portion of the travel of the carriage, depressing the toggle and following it for that period when the stripper punch is to be extended from the ram.

In one preferred embodiment a redraw die arrangement disposed concentrically with the ram is coupled to a suitable reciprocative linkage. A second disk cam, adjacent to the cam used to operate the stripper punch and rotatable therewith, drives a follower for operating the redraw die linkage, in synchronism with the movement of the ram. In a preferred embodiment the cam follower elements for both the stripper punch and the redraw mechanism are carried by and pivoted about a common axis.

Side thrusts imparted to the carriage of the mechanism through the drive linkage, and those due to the intermittent actuation of the toggle which displaces the stripper punch, are isolated from the ram by means of an articulation joint which separates the carriage into two sections. Forces which tend to urge the carriage laterally are absorbed by the rear section of the carriage, which is pivotally coupled to a forward section which in turn carries the ironing ram. Lateral runout of the rear carriage section thus does not affect the location of the forward section as the ram is carried forward and back along the machine ways.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
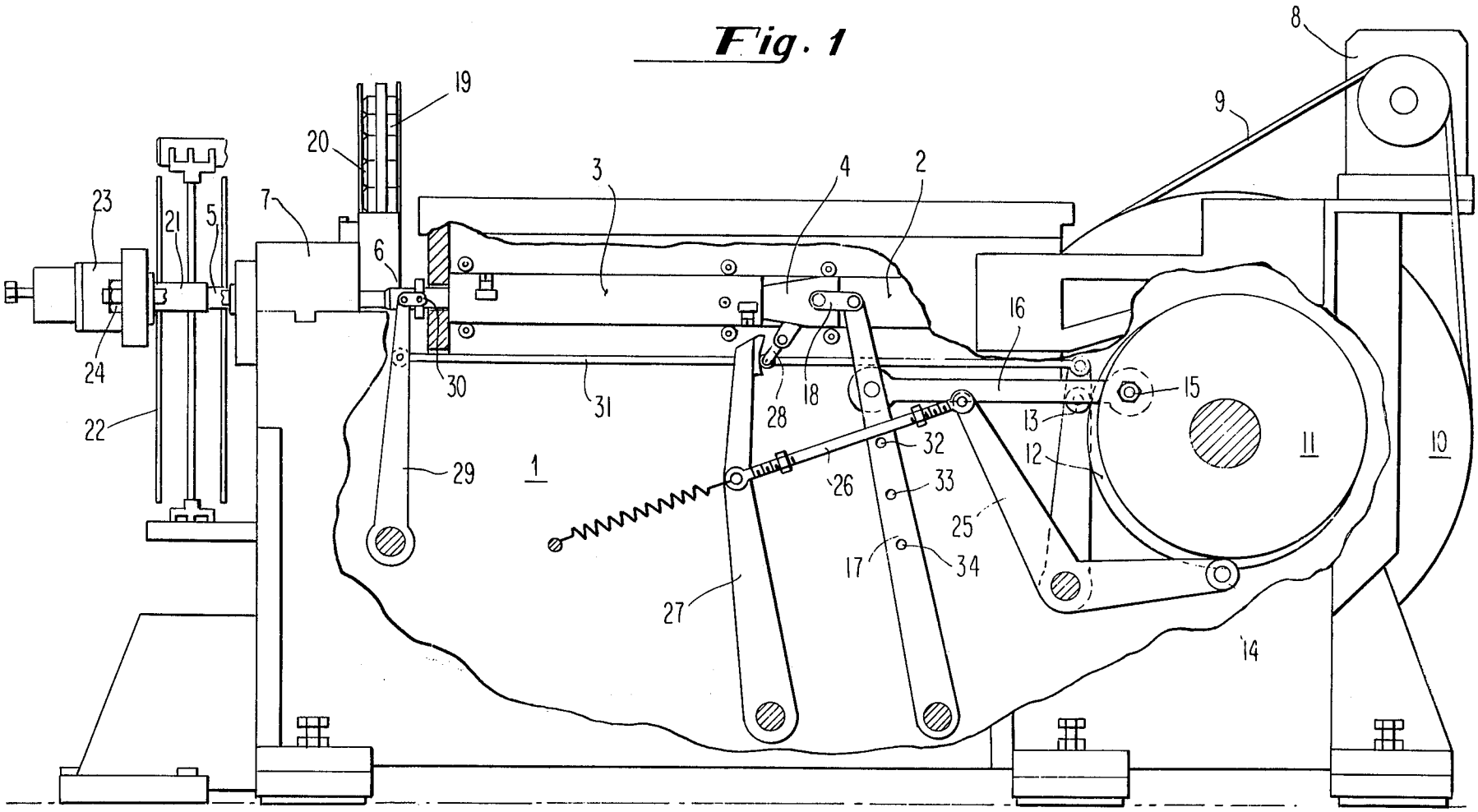
FIG. 1 is a partially sectioned view of a can forming machine incorporating teachings of the present invention.

FIG. 1 represents a side elevation of a machine adapted to form one-piece metallic containers through a process of ironing or drawing and ironing. The machine consists of a body or main frame generally designated 1 having formed therein a plurality of elongate ways 2. The ways support and guide a translatable carriage, here shown as comprising a forward section 3 and rear section 4. Extending from the forward section of the carriage, and carried thereby, is an elongate cylindrical ironing ram 5, shown protruding through a drawing die 6 and a tool pack 7. The illustrated tool pack includes a female drawing die which receives male drawing die 6 in a manner familiar to those skilled in the art. Motive means such as electric motor 8 is coupled by means of a plurality of V-belts 9 to a flywheel assembly 10, which may advantageously incorporate a suitable clutch mechanism. A flywheel 10 is visible behind the frame of the machine. A first cam 11 and second cam 12 are coupled to the near end of a crankshaft at whose distal end is mounted the flywheel. Cams 11 and 12 take the form of generally planar disks whose radial dimensions vary with angular displacement thereof in order to operate cam followers 13 and 14, respectively, in a desired manner.

Extending between the plate-like cams is a cylindrical journal 15, which may be secured between the cams by means of a stud and nuts or similar fastening mechanisms. In this manner journal 15 and cams 11 and 12 cooperate to form a crankshaft assembly. Attached to journal 15 is a connecting rod 16 coupled to a pivoted driving lever 17 intermediate the ends thereof. The lower extremity of lever 17 is journaled upon a suitable support while the upper end is coupled to the rearward section 4 of the carriage by means of a replaceable link 18.

It will now be apparent to those skilled in the art that as motor 8 rotates flywheel 10 and cams 11 and 12, journal 15 describes a circle which causes lever 17 to reciprocate through the mechanism of connecting rod 16. Through link 18, the carriage of the machine is then urged forward and back on ways 2 as the upper end of lever 17 reciprocates in an arc.

When the flywheel has rotated substantially 180° from the position shown in FIG. 1 ram 5 will thus be withdrawn to its rearmost position within, or just protruding from retracted drawing die 6. While the ram is in this position one of a series of metallic blanks 19 moves down infeed chute 20 and assumes a position between the forward end of the ram, and the tool pack.

When a container body has been formed ram 5 retreats from the advanced position shown in FIG. 1, withdrawing from within the completed container body 21. The container body then falls into one of a plurality of pockets of conveyor 22 from which it is transported to other machinery for subsequent processing.

A doming die assembly 23 is disposed at the point of full advance of the ram for resiliently receiving the forward end of the ram. The doming die cooperates with the ram to produce a desired indentation in the bottom of the container body. The doming die assembly is advantageously supported by a pair of longitudinally extending metal supports. In the Figure the distant support is obscured by ram 5, the nearer support being sectioned to show the workings of the apparatus. The nearer support is threaded and is coupled to doming die assembly 23 by means of a suitable fastener such as hex nut 24.

In order to assist in the removal of a completed container body from the end of ram 5 an elongate stripper punch is disposed within the ram. Cam 11 is contoured to effect advancement of the punch with respect to the ram at the proper time in the sequence of operation of the machine. As cam 11 rotates cam follower 14 moves downward to cause clockwise rotation of arm 25, which pulls on a rigid, adjustable link 26 to effect a counterclockwise movement of a pivoted arm 27. In order to actuate the stripper punch carried within ram 5, a toggle 28 is pivotally mounted to the rear section 4 of the carriage and adapted to contact a shoe cam formed at the upper end of arm 27.

Further, and in accordance with one novel aspect of the present invention a pivoted lever 29 is coupled to drawing die mechanism 6 by means of link 30. An elongate rod 31 couples a point intermediate the ends of lever 29 to cam follower 13. In this manner, the drawing die is caused to advance and retreat periodically in accordance with the rotation and contour of cam 12.

Lever arm 17 is advantageously provided with a plurality of sets of aligned holes 32, 33 and 34. The various holes are located at differing distances from the center of rotation of the lever. By coupling the forward end of connecting rod 16 to an appropriate set of holes, the length of the throw of lever 17 may be selected to suit the container to be formed, and the tooling arrangement in place upon the machine. For example, should it be determined that a longer travel for ironing ram 5 is desired the leftward end of connecting rod 16 can be removed from its illustrated location, and aligned with hole 32 which is closer to the center of rotation of lever 17. A fastener is then passed through the aligned lever and connecting rod to secure them together while allowing the requisite pivotal action. Alternatively, it may be preferable to replace arm 17 with one having a hole in a different location.

By increasing the length of the stroke of the machine the original points of furthest retreat are no longer attained since the carriage and ram assembly then reciprocate in a path longer than but centered about its prior path. Conversely, if stroke length is decreased the new path to be traversed by the ram will lie within the previous path. In the former instance the ram may advance too far and damage the doming die; in the latter instance, the lesser advancement may be insufficient to properly form the container body. However, the disclosed system is easily adapted to compensate for these problems. In particular, the length of connecting rod 16 or, more conveniently, that of link 18 may be effectively changed by substituting a new link whose length is determined by the difference in stroke length which has been obtained. In this manner, the carriage may be caused to retreat to its previous position on each stroke, or alternatively, to advance to its furthest position in order to secure proper cooperation with doming die assembly 23. Such a modification may be performed easily with the illustrated arrangement, the links advantageously being coupled to the cooperating members by means of threaded fasteners or the like.

Figure 2:
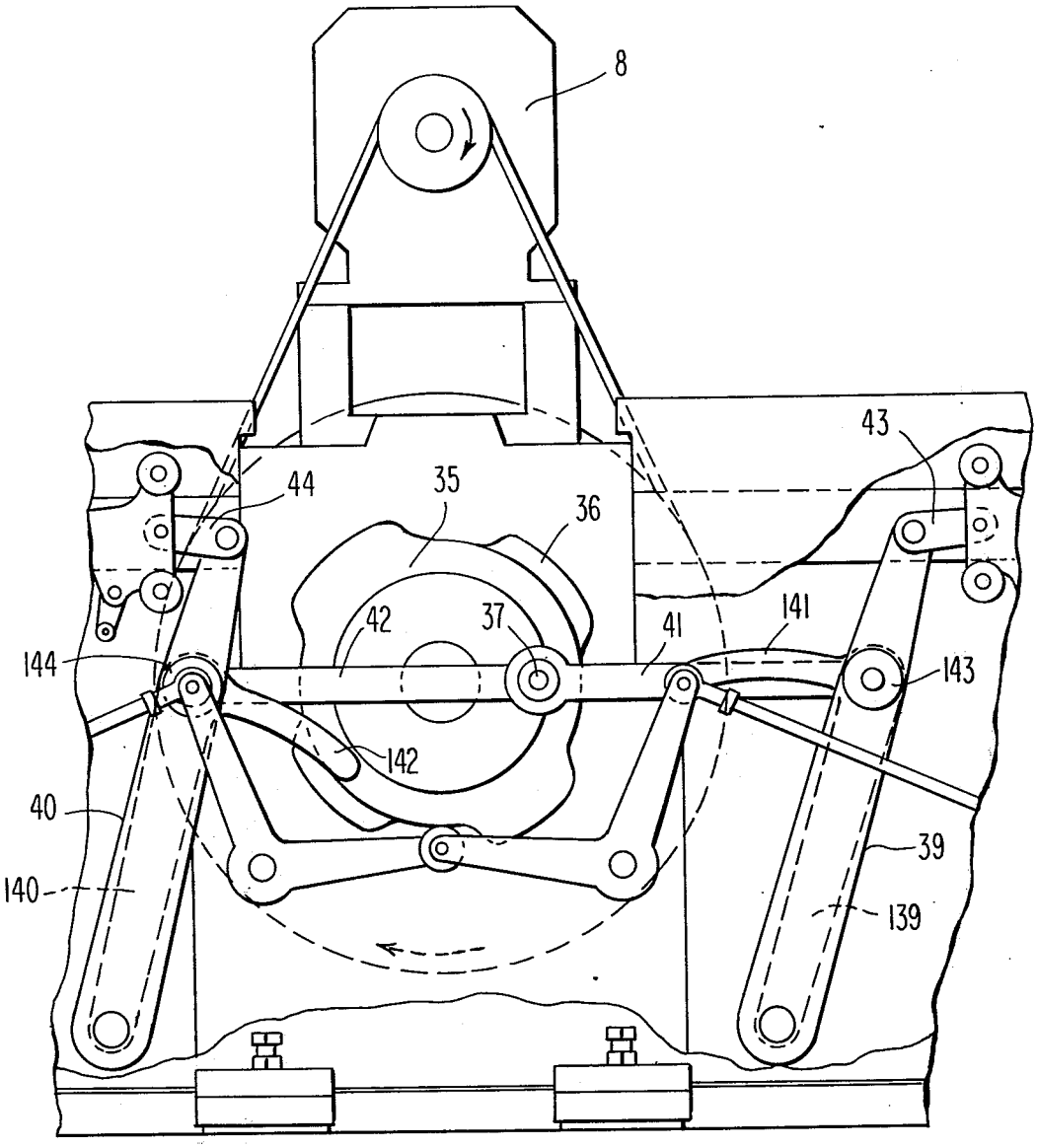
FIG. 2 discloses a common driving arrangement for operating a pair of machines of the type shown at FIG. 1.

Turning now to FIG. 2, there is shown an alternative embodiment of the drive assembly in which a common motive means, flywheel and cam assembly serve to drive a pair of can forming machines disposed in back-to-back relationship. Although multiple head forming machines are known in the prior art, for instance, that disclosed in U.S. Pat. No. 3,167,044-Henrickson, the present invention utilizes separate "siamesed" machines driven by a common motive element and includes other features to be described hereinafter. A common drive motor 8 is mounted atop a drive section between the machines and coupled to a flywheel (shown in phantom form to facilitate the illustration) by means of suitable belts or gears. Behind the flywheel a first cam 35, corresponding to cam 11 in FIG. 1, is seen. Disposed immediately behind cam 35 is another cam 36, which corresponds to cam 11 of FIG. 1. A crankpin 37 extends outwardly from the plane of the drawing and is attached to an end flange on the crankshaft, in front of cams 35 and 36.

In order to translate the rotary motion of crankpin 37 into the requisite periodic, oscillatory motion pivoted levers 39 and 40 are provided. The levers are advantageously journaled at their lower ends about appropriate supports and are provided with a plurality of holes along the lengths thereof for accepting the ends of connecting rods 41, 42. In this manner the length of the stroke afforded the various carriages may be changed, either simultaneously or independently, in order to provide each of the machines with a desired stroke length.

The upper ends of the levers 39 and 40 are attached links 43 and 44, respectively. Each link is coupled to the reciprocating carriage assembly of one of the container forming machines, advantageously in the manner shown in FIG. 1. By changing the length of links 43, or 44, the desired positioning of the carriage assembly may be achieved regardless of changes in length of stroke.

In coupling a plurality of machines to a common drive system, an inconvenience may occasionally occur when it is desired to stop one of the machines for maintenance, repair or adjustment. With both machines driven by a common drive means it might be thought necessary to disable both machines, which substantially negates the advantages which otherwise arise from driving both machines from a common source. Thus, production from both machines would have to be terminated in order to allow work to be done on only one.

In order to overcome this serious disadvantage, the inventor has provided latching means for separately coupling each of the carriage assemblies to the driving means. As shown in FIG. 2, in a presently preferred embodiment a second inner pair of pivoted levers 139 and 140 are aligned with pivoted levers 39–40 respectively and mounted upon a common journal therewith. The inner levers, shown in dotted form, are in part obscured by the main levers 39 and 40. Each of the inner levers is provided with an extension 141, 142 the purposes of which will be discussed hereinafter. These extensions are visible as they protrude from behind the main, outer levers 39 and 40 respectively.

Also mounted on each outer lever 39, 40 is a solenoid 143 and 144, respectively. As is familiar to those skilled in the art, each solenoid comprises an annular winding encircling a cylindrical core which is axially movable within the coil in response to a flow of current through the coil. In a first, engaged position the core of solenoid 143 extends inwardly from the plane of the drawing to engage a mating opening in inner lever 139. Connecting rod 41 is advantageously provided with a bushing having a tapered inside diameter. The connecting rod is coupled to lever 139 at all times such that lever 139 continues to reciprocate with the connecting rod as long as crankpin 37 is in motion.

In order to disengage one of the twin ironing machines, for instance the one lying to the right in FIG. 2, drive motor 8 is deenergized and the rotation of crankpin 37 ceases. Solenoid 143 is energized to cause the core element thereof to be withdrawn from within the tapered bushing of connecting rod 41. In a preferred embodiment, a microswitch is contacted by the withdrawn core element of the solenoid to ensure that the solenoid will remain energized, and the core remain in its withdrawn position, as long as desired.

With lever 39 thus disengaged from connecting rod 41 and inner lever 139, motor 8 may be restarted and the drive means set in motion. However, while the resulting motion of connecting rod 41 continues to effect the reciprocation of inner lever 139, due to the withdrawal of the core of solenoid 143 lever 39 is disengaged from the drive means and remains motionless. This allows repair or maintenance to be accomplished on the right-hand machine.

When it is desired to restart the right-hand machine, motor 8 is again deenergized and the common motive system brought to a stop. If necessary, the system may be "jogged" in small increments in order to align the bushing of connecting rod 41 with the core of solenoid 143. Small errors in misalignment may be overcome through the use of a cooperating tapered core and bushing. Solenoid 143 is then deenergized or alternatively energized in the reverse manner, as appropriate for the particular solenoid used. The solenoid core is thus thrust inwardly toward the inner lever and associated connecting rod. After the core seats within the connecting rod bushing, motor 8 may be restarted. Occasionally, the solenoid core may not fully engage its mating bushing; or it may in some instances be desired for the solenoid core to engage the bushing while connecting rod 41 is in motion. In order to allow this without the danger of the solenoid core being caught upon the edge of connecting rod 41 or inner lever 139, the inner lever is provided with an extension 141. Extension 141 lies in an arc centered about the pivotal axis of levers 39 and 139 such that during reciprocation of lever 139, extension 141 passes beneath the core of solenoid 143. In this manner should the solenoid be accidentally deenergized, or if for any other reason the core is caused to be thrust inwardly it will ride over extension 141 until it comes into alignment with the connecting rod bushing. At this time the core will engage the bushing so that reciprocation of the outer lever 39, and thus the ironing ram, will commence.

Figure 3:
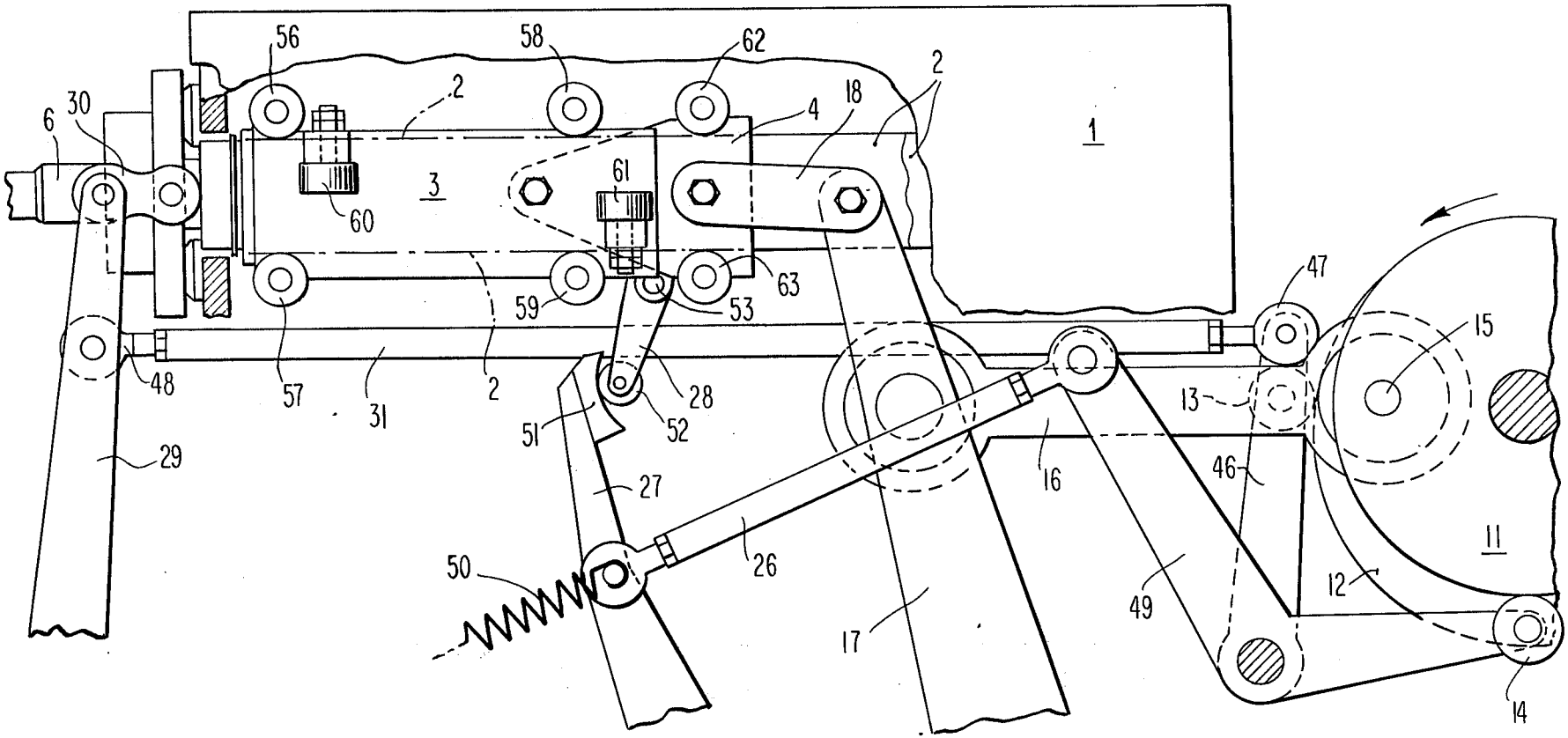
FIG. 3 is a detailed diagram of a portion of a container forming machine, showing certain aspects of the present invention.

FIG. 3 depicts in detail the construction and operation of the linkages utilized to operate the drawing die and stripper punch of the container forming machine. Cam follower 13, illustrated herein as a circular bearing element, bears against the outer periphery of cam 12 and is supported upon a pivoted arm 46. At the upper end of arm 46 a coupling 47 is attached which coupling forms the rearmost end of a rigid, elongate rod 31. The forward end of rod 31 is attached by means of a second coupling 48 to a point intermediate the ends of an arm 29. As set forth with respect to FIG. 1, the lower end of arm 29 is journaled upon a suitable support which is advantageously anchored to the frame of the machine. The upper end of arm 29 is pivotally coupled to a link 30, the opposite end of which connects to a flange associated with drawing die 6.

In operation, as cam 12 rotates the radial distance between the center of rotation thereof and cam follower 13 varies. In response to this variation follower 13 reciprocates, moving rod 31 and thus arm 29. This in turn effects a periodic advancement and withdrawal of drawing die 6 into a mating female drawing die disposed within tool pack 7. As will be understood by those skilled in the art container body blanks placed in front of die 6 are penetrated by the forward end of the die and urged forwardly into the cooperating, female die where they are resized and stretched preparatory to the advancement of ironing ram 5 through die 6. As the ram penetrates the drawing die it urges the drawn container blank through a series of ironing dies to thin and elongate the lateral walls of the container.

It will be appreciated by those skilled in the art that in some instances it is unnecessary to redraw blanks before ironing. In such a case it would be beneficial to be able to render the drawing mechanism inoperative, without hindering the operation of those portions of the machine which perform the ironing operation. With the present mechanism this goal is easily achieved by uncoupling rod 31, thus breaking the connection between cam 12 and drawing die 6. Of course, some or all elements of the linkage could alternatively be removed or disconnected, the removal of rod 31 being the most expedient approach with the disclosed embodiment.

Coupled to cam 12 and rotating therewith is another cam 11 which is contoured to effect the advancement and withdrawal of a stripping punch (not shown). The punch is coaxially disposed within ironing ram 5, and carried by the ram and thus by the carriage assembly. Cam follower 14, here shown as a roller element, is disposed at one end of an arm or bellcrank generally designated 49. The bellcrank is advantageously journaled about a common support with pivoted arm 46, although it will be recognized by those skilled in the art that while this mounting is compact and economical alternative placements are possible and may be desirable with other embodiments of the apparatus. Link 26 is coupled to a point intermediate the ends of a pivoted arm 27 which is in turn journaled at its lower end about a support fixed to the frame of the machine. In order to biasedly maintain follower 14 against the periphery of cam 11 a tension-type coil spring 50 is attached to arm 27.

The upper end of pivoted arm 27 is advantageously provided with a contoured shoe 51 which bears against a follower 52 disposed at the lower extremity of toggle 28. As set forth in the description of FIG. 1 toggle 28 is pivotally mounted to the carriage assembly, and held in place by suitable means such as a bolt 53.

As cam 11 rotates it displaces follower 14 downwardly, and thus effects the clockwise rotation of bellcrank 49. The bellcrank then acts through link 26 to effect a corresponding rightward movement of arm 27. Judicious design of the cam profile determines the rate at which shoe 51 moves rearwardly with respect to the carriage assembly. Since toggle 28 is carried by the carriage assembly it is the relative motion of shoe 51 with respect to the carriage which determines the motion, of the toggle and therefore the speed of advancement or withdrawal of the stripper punch within ironing ram 5.

Figure 4:
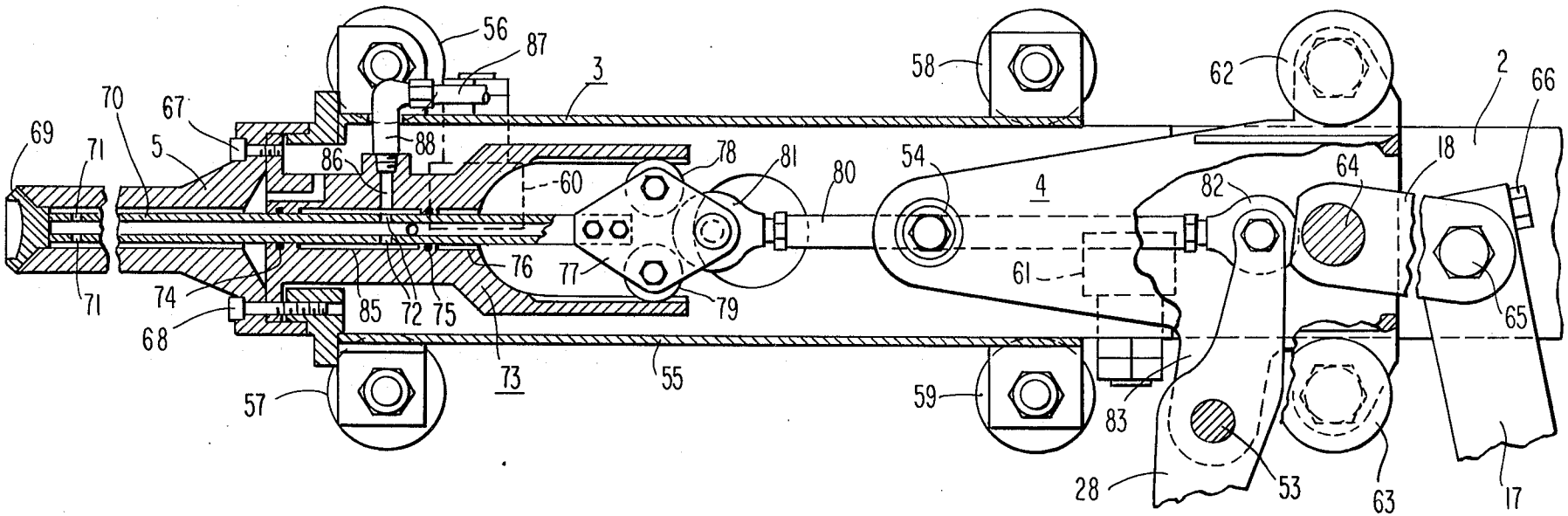
FIG. 4 illustrates details of the construction of the reciprocal ram and stripper punch of the machine.

FIG. 4 shows, in partially section form, the carriage assembly which reciprocates within the main frame of the container forming machine, carrying the ram which urges metal blanks through the ironing dies in order to form the blanks into elongate one-piece container bodies. The carriage assembly comprises a forward section 3 which is pivotally coupled to a rear section 4 by means of a trunnion 54 which extends through mating apertures in aligned sections of forward and rear carriage section 3 and 4.

The body portion 55 of the forward section is advantageously formed of heavy-wall seamless mechanical tubing, and is provided with suitable apertures to facilitate the assembly and maintenance of the various components to be assembled therewithin. A plurality of hardened rollers 56–59 are supported by steel fillets welded to appropriate points upon body portion 55. The axes of rollers 56–59 are oriented in the horizontal plane, the rollers bearing against the top and bottom of horizontal ways formed in the frame of the machine. The rollers thus serve to vertically locate the forward section of the carriage as it describes its course through the machine. Additional rollers 60 and 61, whose axes are oriented vertically, are mounted upon suitable supports welded to body 55 and cooperate with other ways in the frame of the machine. Rollers 60 and 61 bear against vertical surfaces of the latter ways to provide horizontal location of the forward section of the carriage.

The rear section 4 of the carriage assembly is fabricated from an appropriate material such as steel plate. The side members of the rear section extend forwardly into front section 3, being encaptured therein by suitable pivoting means such as trunnion 54. A pair of rollers 62 and 63 are visible in the illustration, their axes being horizontal and the rollers are adapted to bear against upper and lower horizontal surfaces, respectively of ways 2. This arrangement provides vertical location to the rear section of the carriage assembly. In the illustrated embodiment, it has been found unnecessary to provide additional rollers having vertical axes to the rear section since the combination of the pivotal coupling between the sections of the carriage assembly and rollers such as those shown at 60 and 61 of FIG. 4 have been found to provide adequate lateral location to the rear portion 4 of the carriage. Of course, it will be recognized by those skilled in the art that should additional lateral support be called for, other rollers may easily be added to the rear section of the carriage.

In the embodiment shown in FIG. 4, a portion of the rear section 4 of the carriage assembly is cut away to show the mounting of the elements therein. An elongate pin 64, which may comprise a hardened bolt of suitable dimensions, extends through the reinforced side walls of rear sections 4 and encaptures the forward end of link 18. Link 18 then drivingly couples the carriage assembly to pivoted lever 17, advantageously by means of a pivot member such as bolt 65. Bolt 65 is journaled within link 18 and tightly encaptured within the upper end of pivoted lever 17 by pinch bolt 66.

In order to advance the carriage assembly along the ways of the main frame of the container forming machine the pivoted lever 17 is caused to move leftward by suitable means, such as the crankshaft and connecting rod assembly disclosed in FIG. 1. Due to its pivoted mounting, however, lever 17 does not traverse a straight path leftward, but rather describes a counterclockwise arc. The varying alignment between the rear section 4 of the carriage assembly and the upper end of lever 17 is compensated for by link 18, which pivots on bolts 64 and 65. Nonetheless, as will be recognized by those skilled in the art the force transmitted to the rear section 4 of the carriage assembly must act along a line extending through the centers of pivots 64 and 65 and is therefore only rarely parallel to the direction of travel of the carriage. Due to this misalignment and the resulting change in resolution of the forces applied to the carriage, an upward or downward force component is constantly being applied to the rear section of the carriage assembly.

Ideally, such forces are absorbed by rear rollers 62 and/or 63. Were it possible to maintain zero clearance between the rollers and the associated ways of the machine, to eliminate all play in the bearings within the rollers, and to eliminate all significant flexure in the ways, the machine frame, the carriage, and the roller supports, no significant misalignment of the carriage would occur. However, and despite the provision of additional rollers along the length of the carriage assembly, it has been found that appreciable transverse displacement or "cocking" occurs. This cocking effect, although relatively slight, is in effect amplified by the length of the ironing ram which extends from the forward portion of the carriage. The transverse motion of the ram assumes unacceptable proportions when the rollers, bearings, and/or ways become slightly worn through normal use.

According to one important aspect of the present invention the carrige assembly overcomes deficiencies in prior art carriages through the incorporation of the illustrated articulated design. Vertical forces transmitted to rollers 62, 63 and which cause the vertical displacement of rear section 4 of the carrige assembly merely occasion a slight pivoting of the rear section about the trunion 54, and do not disturb the vertical alignment of the forward section 3 of the carriage assembly. Therefore, even in the presence of appreciable wear of ways, bearings and rollers, the rear section 4 of the assembly may undergo substantial vertical motion without causing any appreciable misalignment of the forward section or of the extended ram.

While the location of the pivot point formed by trunnion 54 is not critical to the practice of the invention, it is advantageously located between the forward and rearmost rollers of the forward section 3 of the assembly. Moreover, while in a preferred embodiment the pivoted mechanism is assembled by the insertion of lateral members of rear portion 4 within the forward section, it will be recognized by those skilled in the art that it may be desirable to make rear section 4 wider, so as to receive the rear portion of section 3 therewithin. Such matters are regarded as details of design, and not of moment with respect to the basis of the present invention.

Figure 5:
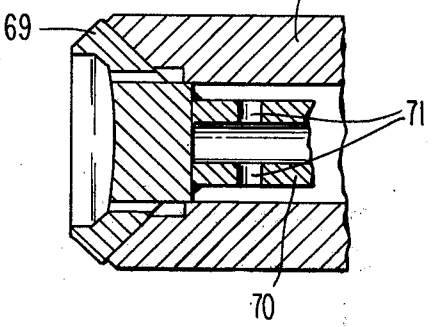
FIG. 5 is an enlarged view of the forward end of the reciprocal ram.

Turning now to another aspect of the present invention set forth in FIGS. 4 and 5, ironing punch 5 is secured to the forward end of section 3 of the carriage by means of bolts 67, 68. As is known to those skilled in the art, ram 5 comprises an elongate cylindrical element whose forward end is adapted to urge metal blanks through successively smaller annular dies in order to form a finished one-piece container body. As the ram advances to its furthest position, it encounters a resilient doming die assembly which cooperates with the ram end to deform the bottom of the container body in a desired manner. The container end is commonly indented to provide a concave surface, which adds strength and rigidity to the completed container. After doming is accomplished the ram begins retreat, and to withdraw from within the completed container.

As the container has been tightly formed along the forward end of the ram, some difficulty has been encountered in cleanly "stripping" the completed container from the ram. In some cases, a set of spring-loaded pawls have been provided about the exit end of the tool pack for engaging the lip of the completed container body and preventing it from following the ram during its retreat. However, the container often tears and buckles due to the vacuum created therewithin by the withdrawal of the ram, and due to the frictional forces between the container body and the ram. For this reason, it has been found advantageous to provide additional means to aid in stripping the container from the ram.

In the present invention, such means take the form of a stripper punch comprising a head 69 which is tightly nested into the forward end of ram 5 and which cooperates with a doming die to determine the configuration of the bottom of the completed container body. The stripper punch also comprises an elongate stem 70, advantageously tubular in form. The stem is coupled to head 69 and extends throughout the length of ram 5, terminating rearwardly of the ram body within the forward section 3 of the carriage assembly. Radial apertures 71, 72 are provided at suitable points along the stem and serve to allow the egress and ingress, respectively, of compressed air for purposes to be later described. A ram support 73, advantageously formed of hardened steel, extends within the forward portion of the carriage assembly and slidably supports the rearward portion of stem 70 of the stripper punch. Seals 74 and 75, which may be rubber O-rings, serve to provide a tight seal about the periphery of stem 70. This keeps lubricant and compressed air from flowing forwardly within ram 5. A bushing 76 is disposed in the rearward end of ram support 73 for slidingly supporting the stem of the stripper punch as it reciprocates within the ram.

The rearward end of stem 70 is attached to a punch carrier 77 by suitable means, such as the depicted bolts. The hollow end of the stem is plugged to prevent the escape of compressed air. The carrier is provided with upper and lower rollers 78 and 79, respectively which roll in grooves or tacks formed in the top and bottom of ram support 73. Carrier 77 is coupled to a pushrod 80 through a bearing joint 81, the rearward end of rod 80 being secured to toggle 28 by means of a similar joint 82.

The plates forming the sides of rear section 4 of the carriage assembly are each provided with a downwardly-depending element 83. Element 83 receives the ends of a pivot pin 84 to allow toggle 28 to pivot back and forth in response to the actuation of intermediate linkage members by cam 11, as has been described hereinabove.

As the ram 5, and thus the carriage assembly, advances to its furthest position the cam and linkage assembly is oriented so as to begin to urge the lowermost portion of toggle 28 rearwardly with respect to the carriage. As the carriage, and thus the pivot point of toggle 28, commences its retreat shoe 51 and lever 27 retreat also, but at a higher rate such that toggle 28 is caused to rotate in a counterclockwise fashion. The rotation of the toggle causes a leftward advance of rod 80, carrier 77 and therefore head 69 of the stripper punch. In practice it has been found advantageous to design the cam and linkage mechanism so as to cause the head 69 of the stripper punch assembly to remain stationary with respect to the machine frame while ram 5 retreats. The container which has been formed during the advance of the ram is thus held stationary while the ram commences its retreat.

After the end of the ram has retreated from within at least a portion of the container body, cam 11 causes the stripper punch to retreat at a more rapid rate than the punch. The head 69 of the stripper punch finally overtakes the retreating forward end of ram 5 and seats thereon in a desired manner, determined by the contours of cam 11. In this manner an abrupt, severe impact between head 69 and ram 5 is avoided, prolonging the life of the mechanism and avoiding breakage and deformation of the abutting elements. Moreover, use of carrier 77 along with cooperating rollers 78, 79 which traverse the guideway formed in ram support 73 assures the free reciprocation of the stripper punch, preventing sideways deflection of the end of stem 70 and accordingly eliminating any binding or galling the stem within ram support 73.

As the end of ironing ram 5 withdraws from within a newly formed container, the container being held stationary by the stripper punch, a vacuum is created within the container due to the retreat of the ram end. In view of the relatively thin walls of the container, outside air pressure would cause the container to collapse unless the pressure differential could be relieved. It has been found that merely venting the inside of the container to the atmosphere through passages within ram 5 and/or in the stripper punch, is unsatisfactory. This is because the pressure drop occasioned by the air rushing through the narrow interstices within the ram and punch assembly does not sufficienty alleviate the low pressure within the container. For this reason, the present invention incorporates means for supplying pressurized air to the interior of the container as ironing ram 5 retreats therefrom.

Openings 72 provide communication between the hollow interior of the stem 70 of the stripper punch and a cavity 85 formed within ram support 73 and concentric with stem 70. Also communicating with cavity 85 by means of a passageway 86 drilled in the ram support is a source of compressed air (not shown) coupled to the passageway by flexible line 87. Line 87 is advantageously secured to ram support 73 by means of a suitable fitting 88. In a preferred embodiment of the invention, a gated valve is interposed between the source of compressed air and line 87 and coupled to the driving mechanism so as to be periodically opened. In this manner a charge of compressed air is introduced into the stem 70 of the stripper punch as the punch begins to extend from ironing ram 5, equalizing the pressure within the formed container from which the ram is being withdrawn. As will be evident from the Figure, cavity 85 extends for a suitable length along stem 70 so that the opening 76 in the stem of the stripper punch continues to receive air despite the advancement of the stem within the ram carrier body. The air transmitted through the central passage in the stem 70 is expelled through openings 71 in the stem, and other openings in the head, of the stripper punch. The air then passes between the head of the punch and the retreating end of the ironing ram, filling the interior of the container body.

Figure 6:
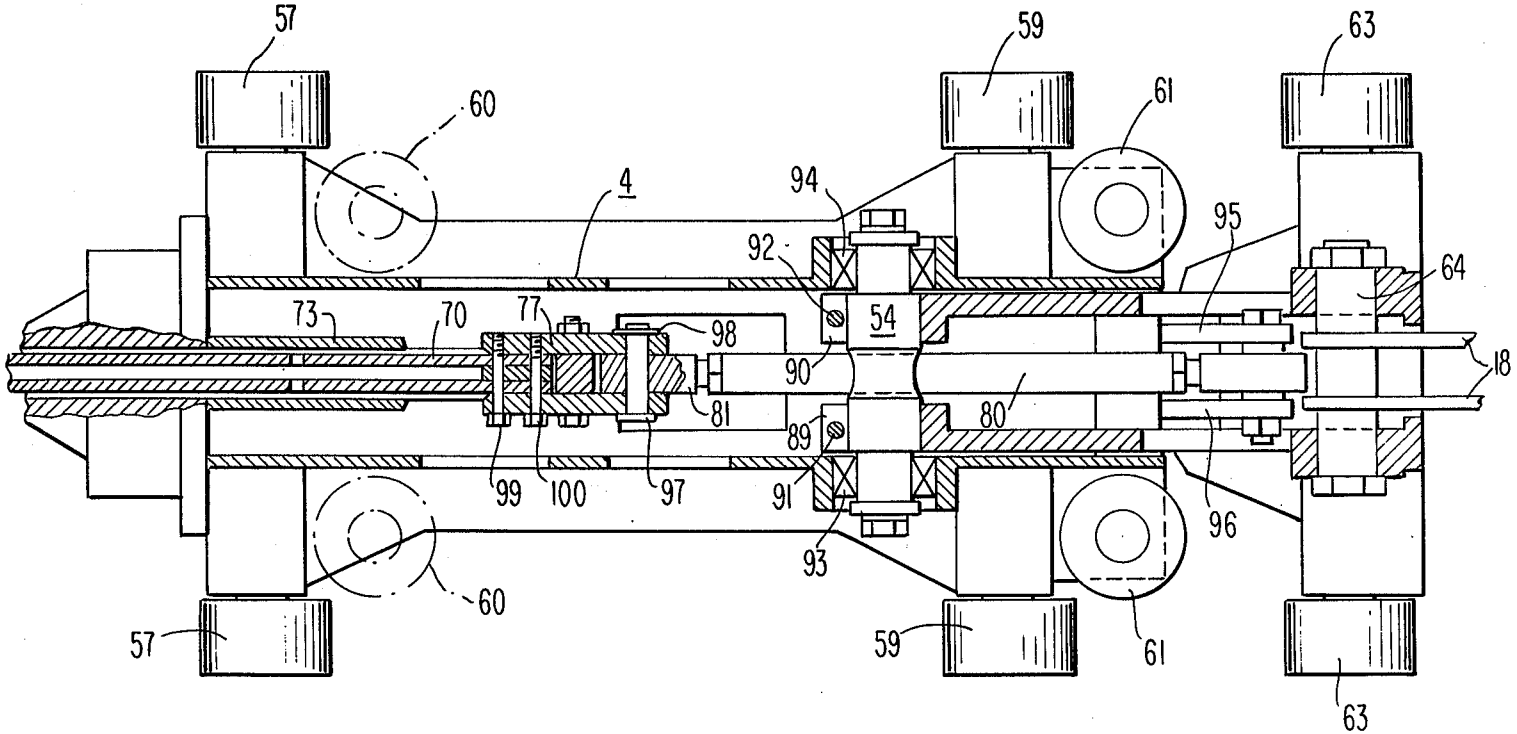
FIG. 6 is a partially sectioned top view of the carriage of FIG. 4.

Turning now to FIG. 6, there is shown a sectioned top view of the carriage assembly, illustrating in further detail the construction of various portions of the assembly and the components carried thereby. In particular, trunnion 54 is visible and is provided with an aperture through which stem 80 passes. The inner, enlarged diameter of the trunnion is encaptured within supports 89 and 90 which are formed at opposite side members of the rear section 3 of the carriage assembly. Pinch bolts 91 and 92 serve to clamp supports 89 and 90 securely about the enlarged ends of trunnion 54. The outer, smaller diameters of the trunnion are supported by suitable bearings 93, 94 which are disposed at opposite sides of the forward section 4 of the carriage assembly to provide ease in rotation of the rear section with respect thereto.

The rearward end of pushrod 89 is encaptured between mating halves 95 and 96 of toggle element 28. The upper end of the toggle 28 is advantageously located so that at its rearmost excursion it lies slightly forward of link 18, shown here as comprised of two parallel plates journaled upon pin 64.

A bearing joint 81 is disposed at the forward end of pushrod 80 and is coupled to carrier 77 by means of a hardened pin 97 having a suitable retainer clip 98 affixed to smaller end thereof. A pair of bolts 99, 100 are threaded through the body of carrier 77 and serve to hold a plug securely in the bore of stem 70 of the stripper punch in order to prevent the escape of compressed air from within the punch.

As the carrier assembly is translated along the ways of the machine frame, the vertical force is transmitted to the rear portion 4 of the carriage assembly by way of link 18. Any play or movement of rear portion 4 effects the rotation of trunnion 54 in bearings 93 and 94. This articulation precludes lateral displacement of the forward portion 3 of the carriage assembly, and therefore of the ironing ram 5. When the ram commences its retreat, the cam-operated linkage assembly causes the upper end of toggle 28 to advance leftward, advancing pushrod 80 through trunnion 54. This in turn urges carrier 77 along the ways or tracks formed in ram support 73, causing the stripper punch to extend from the front end of the ironing ram.

As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit of the scope of the invention.

I claim:

1. In an apparatus for forming drawn and ironed containers and including a reciprocating ram for urging container blanks through at least one annular die, means for aiding in stripping formed containers from said ram comprising:

a stripper punch comprising an elongate rigid stem extending within said ram and having an enlarged head portion adapted to seat against one end of the ram;

a carriage reciprocally guided within said apparatus and carrying said ram;

a toggle member pivotally coupled to said carriage and having a first end coupled to said stripper punch and a second end;

a planar cam element rotatable about a stationary axis in synchronism with the reciprocation of said ram; and an intermediate link mounted to pivot upon a stationary axis and reciprocally operated by said cam element and contacting said second end of said toggle member for maintaining said stripper punch in an advanced position as said ram retreats from said position to allow said ram to withdraw from within a formed container.

2. Apparatus as defined in claim 1, further including means for introducing compressed air into the interior of said ram, said compressed air being expelled from the forward end of said ram simultaneously with the advancement of said stripper punch with respect to the ram.

3. Apparatus as defined in claim 2, wherein said toggle member is pivotally coupled to said carriage intermediate the ends of said toggle member, one end of said toggle being coupled to the rearward end of said stripper punch, the other end of said toggle carrying a follower element adapted to engage said intermediate link.

4. Apparatus as defined in claim 3 further including a pivoted cam follower associated with said cam element, and a rigid link coupling said cam follower and said intermediate link.

5. Apparatus as defined in claim 1 wherein said carriage comprises a first section carrying said ram and a second section carrying said toggle element; and means pivotally coupling said first and second sections.

6. In an apparatus for forming drawn and ironed containers and including a reciprocative ram for urging a metal blank through a plurality of annular dies of progressively decreasing diameter upon advancement thereof and withdrawing from a newly formed container upon retreat, a stripper mechanism for facilitating the removal of the container from the forward end of the ram comprising:

an elongate rigid tube extending axially within said ram;

an enlarged head disposed at a forward end of said tube and having a periphery for registering with a mating surface formed in the forward end of said ram, said head having a generally concave outer surface adapted to cooperate with a doming die for forming an indented surface in the end of a formed container;

a carriage having bearing means to facilitate the reciprocation thereof within said apparatus, said carriage carrying said ram;

a toggle pivotally mounted to said carriage and coupled to said elongate tube;

a cam rotated upon a stationary axis in synchronism with the reciprocation of said ram; and an elongate intermediate member pivotally mounted upon a stationary axis operated by said cam and having a surface bearing against said toggle to cause said toggle to pivot, thereby advancing said tube within said ram.

7. The invention defined in claim 6, further including means for introducing compressed air into the interior of said tube.

8. The invention defined in claim 7, wherein said carriage comprises a first and a second section and further including:

a driven reciprocating member;

a rigid link coupled to said second portion of said carriage;

said ram being attached to and carried by said first section of said carriage assembly;

said toggle member being pivotally mounted on said second section of said carriage assembly; and means pivotally coupling said first and said second sections of said carriage assembly.

9. The invention defined in claim 8, further including a pivoted arm adjacent to and bearing against said cam; and an elongate rigid link coupling said pivoted arm to said intermediate member.

10. In apparatus for forming drawn and ironed metal containers;

an ironing ram having an outside diameter approximating the final inside diameter of a formed container;

ironing die means comprising a plurality of annular dies of progressively decreasing diameter for elongating and reducing the wall thickness of metal container blanks carried by said ironing ram as said ram advances through said dies;

a carriage having friction reducing means provided thereon for supporting and guiding said carriage in elongate ways, said carriage comprising a first and a second portion;

means pivotally linking said first and second portions;

said ironing ram being carried by said first portion; and reciprocative linkage means for coupling the second section of said carriage assembly to a source of motive power.

11. The apparatus defined in claim 10, further including:

a stripper punch having a head seating in one end of said ironing ram and an elongate rigid stem extending from said head through said ironing ram; and a toggle coupled to said stem and pivotally mounted to said second portion of said carriage for effecting the advancement of said stripper punch with respect to said ironing ram.

12. The invention defined in claim 11, further including a cam rotated in synchronism with the reciprocation of said carriage, and linkage means coupling said cam to said lever for periodically advancing said stripper punch relative to said ironing ram.

13. The invention defined in claim 12 wherein said friction reducing means comprise rollers carried by said carriage assembly and adapted to roll in said elongate ways for guiding said carriage assembly along a predetermined path.

14. Apparatus for forming metal containers from blanks supplied thereto, comprising a body portion having formed therein a plurality of substantially parallel guides, a reciprocative carriage disposed upon said guides, driving means for periodically advancing and withdrawing said carriage, a die holder for rigidly supporting a plurality of annular dies, an elongate ram carried by said carriage for urging a metal blank forwardly through said annular dies upon advancement of said carriage and moving rearwardly from within a formed container upon withdrawal of said carriage, said carriage comprising a forward section carrying said ram and a rear section coupled to said drive means, said forward and rear sections being pivotally coupled to articulate along an axis perpendicular to at least some of said guides.

15. Apparatus as defined in claim 14, further including a link coupling said rear portion to said drive means, said link being pivotally coupled to said rear section so as to articulate about an axis parallel to that about which said carriage sections articulate.

16. Apparatus as defined in claim 15, further including a stripper punch slidably disposed within said ironing ram and having a head thereon extensible from the end of said ironing ram to assist in the removal of a formed container from said ram.

17. Apparatus as defined in claim 16, further including a toggle element having a first and a second end, said toggle element being pivotally mounted intermediate said ends to said rear section of said carriage assembly;

means coupling said first end of said toggle element to said stripper punch;

a cam rotatably coupled to said drive means to rotate in synchronism with the reciprocation of said carriage assembly; and linkage means coupling said cam to said second end of said toggle element.

18. In an apparatus for forming metal containers by sequentially drawing blanks to elongate and to reduce the diameter thereof and then ironing the drawn blanks to effect further elongation thereof, said apparatus including a reciprocative ironing ram for urging a drawn blank through a plurality of annular ironing dies of progressively decreasing diameter;

a first drawing die disposed concentrically about said ironing ram;

a second drawing die disposed between said ironing dies and the retracted position of said ironing ram for receiving said first drawing die, and having an aperture therein for allowing said ironing ram to extend therethrough;

a stripper punch disposed within said ironing ram and extensible from the forward end of said ironing ram to allow said ironing ram to withdraw from within a newly formed ironed container;

a first planar cam rotated in synchronism with the advance and retreat of said ironing ram;

a second planar cam coupled to and rotatable coaxially with said first cam;

first and second followers pivotally mounted upon a common axis and urged against said first and said second cams, respectively;

first linkage means coupling said first drawing die to said first follower;

second linkage means coupling said stripper punch to said second follower;

said first and said second linkages each comprising a first arm carrying a follower, a second arm pivotally mounted near one end thereof, and a rigid link coupling said first arm to a point intermediate the ends of said second arm;

a crankpin connected between said first and said second cams and offset from the axis of rotation thereof so as to rotate in a circular locus with said cams; and means coupling said crankpin to said ironing ram for effecting the reciprocation thereof.

* * * * *